US006543537B1

(12) United States Patent
Kjos

(10) Patent No.: US 6,543,537 B1
(45) Date of Patent: Apr. 8, 2003

(54) METHOD AND APPARATUS FOR PRODUCING AN OIL RESERVOIR

(75) Inventor: Tore Kjos, Oslo (NO)

(73) Assignee: Read Group AS, Hvalstad (NO)

( * ) Notice: Subject to any disclaimer, the term of this patent is extended or adjusted under 35 U.S.C. 154(b) by 0 days.

(21) Appl. No.: 09/743,701

(22) PCT Filed: Jul. 9, 1999

(86) PCT No.: PCT/NO99/00232

§ 371 (c)(1),
(2), (4) Date: Jan. 16, 2001

(87) PCT Pub. No.: WO00/03118

PCT Pub. Date: Jan. 20, 2000

(30) Foreign Application Priority Data

Jul. 13, 1998 (NO) ..... 19983211

(51) Int. Cl.[7] ..... E21B 43/00; E21B 36/00; E21B 43/40

(52) U.S. Cl. ..... 166/266; 166/57; 166/302

(58) Field of Search ..... 166/57, 90.1, 265, 166/266, 268, 302, 357, 901

(56) References Cited

U.S. PATENT DOCUMENTS 3,766,985 A * 10/1973 Willhite ..... 166/302
4,738,779 A 4/1988 Carroll et al.
5,353,869 A * 10/1994 Allen ..... 166/302
5,456,837 A * 10/1995 Peachey ..... 166/265

FOREIGN PATENT DOCUMENTS

| | | |
|---|---|---|
| WO | 94/13930 | 12/1993 |
| WO | 97/11254 | 9/1996 |
| WO | 97/25150 | 1/1997 |

* cited by examiner

*Primary Examiner*—David Bagnell
*Assistant Examiner*—Brian Halford
(74) *Attorney, Agent, or Firm*—Browdy and Neimark, P.L.L.C.

(57) ABSTRACT

A method for producing an oil reservoir, comprising establishing an oil producing well, producing a production fluid containing oil and water, transporting the production fluid to a downhole liquid/liquid hydrocyclone, separating the fluid in the liquid/liquid hydrocyclone into an oil enriched stream at the hydrocyclone underflow, transporting the oil enriched stream to the surface, reinjecting the water enriched stream at a downhole site, cooling the transported oil enriched stream by sending a counterflow of a cooling medium relative the oil enriched stream, thereby keeping the oil enriched stream in a substantially liquid phase.

11 Claims, 3 Drawing Sheets

METHOD AND APPARATUS FOR PRODUCING AN OIL RESERVOIR

FIELD OF INVENTION

The present invention relates to a method and an apparatus for producing an oil reservoir. The invention is developed in connection with the demand and need for production of deeper localized and mostly relatively small oil reservoirs. When producing such oil reservoirs it is regularly necessary to inject water in the resevoir thereby forcing out the hydrocarbons from the reservoir.

BACKGROUND

Increasingly, oil producers are looking for ways to produce oil from wells in which the production fluid has a high water cut efficiently enough to make the cost of production economic. One known method is to separate the production fluid in a downhole separator comprising one or a series of hydrocyclones in order to provide initial separation of at least some of the water from the production fluid to reduce the quantity of production fluid which needs to be transported to the surface. The separated water is re-injected, to the oil reservoir or another site.

SUMMARY OF INVENTION

According to the present invention a method for producing an oil reservoir is provided, comprising establishing an oil producing well, producing a production fluid containing oil and water, transporting the production fluid to a downhole liquid/liquid hydrocyclone, separating the production fluid in the liquid/liquid hydrocyclone into an oil enriched stream at the hydrocyclone overflow, and a water enriched stream at the hydrocyclone underflow, transporting the oil enriched stream to the surface, re-injecting the water enriched stream at a downhole site, and cooling the transported oil enriched stream by sending a counterflow of a cooling medium relative the oil enriched stream, thereby keeping the oil enriched stream in a substantially liquid phase.

By cooling the ascending oil enriched stream the stream liquid phase is kept as long as possible, thereby substantially avoiding gas formation.

When producing a reservoir containing volatile oils the production fluid will be subject to a volatilazation caused by a pressure reduction upwards in the well. A cooling of the upwards flowing upstream in the well will cause a temperature reduction balancing the pressure reduction, whereby the condensation curve in the corresponding phase diagram is not crossed. Thus gas will not evolve and a multi-phase situation is avoided. The result is a preventive liquidation in that the stream is hindered in giving away the volatile heat and will remain in the same phase, that is the liquid phase. Some of the most volatile components will of course evolve and remain in the gaseous phase bit it is estimated that the bulk of the gas phase will not evolve but remain in the liquid.

The counterflow may advantageously be used as the driving medium for a pump transporting the oil enriched stream.

The cooling medium may preferably include injection water, delivered from a water pump at or above the surface.

Provided the cooling is not sufficient to avoid a disturbing gas phase the oil enriched stream can be pressurized in one or more additional downhole pumps positioned in the well above the transportation pump. Thereafter the stream is cooled further, striving to keep the stream outside the condensation line in the phase diagram.

The cooling medium may include re-injection water provided from an aquifier, i.e. an underground site containing water. Water drawn from an aquifier is preferably separated in a downhole solid/liquid hydrocyclone, whereby the separated water is re-injected in the producing reservoir and the solids are re-injected in the ground, for instance in the aquifier.

The present invention also provides an apparatus for producing an oil reservoir, the apparatus comprising a downhole liquid/liquid hvdrocyclone for separating production fluid containing oil and water into an oil enriched stream and a water enriched stream, a downhole pump for pumping the oil enriched stream to the surface, and means for sending a counterflow of cooling medium relative the oil enriched stream.

The means for sending the counterflow may preferably include a means for sending a flow of injection water down the well.

Preferably the downhole transporting pump may be in driven connection with a downhole injection water driven turbine.

Also a re-injection water pump may preferably be in driven connection with said downhole turbine.

As disclosed above in connection with the inventive method the apparatus will preferably include one or more additional downhole pumps for transport (pressurizing) of the cooled oil enriched stream.

The apparatus may further include a downhole solid/liquid hvdrocyclone in the well at a position above the downhole transport pump, said hydrocyclone being flow coupled to an aquifier by means of a pump and having an overflow delivering separated water down to the oil producing reservoir, and an underflow delivering separated solids to an underground site.

BRIEF DESCRIPTION OF DRAWING

The invention will now be described with reference to the drawings, in which.

DETAILED DESCRIPTION OF EMBODIMENTS

Figure 1:
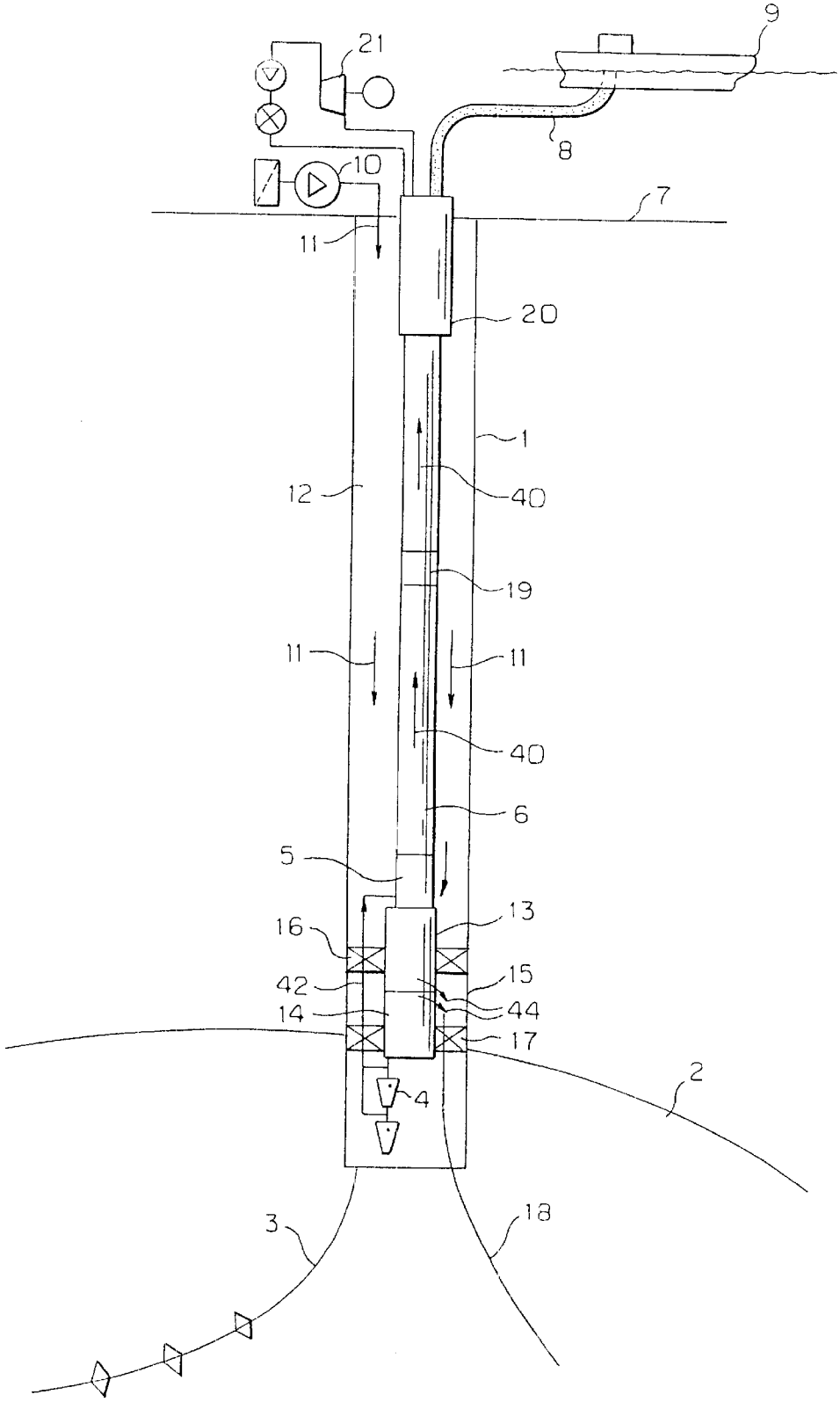
FIG. 1 is a schematic diagram of an apparatus according to the invention.

As shown in FIG. 1, a well 1 penetrates into a production formation 2. A deviation well 3 is used for the production of oil from the formation or reservoir 2. A production flow 46 (see FIG. 2) from the well 3 is transported to a series of liquid/liquid downhole hydrocyclones 4 where the production flow is separated in an oil enriched stream 42 from the overflows and a water enriched stream from the underflows. A downhole pump 5 provides for the transport of the oil enriched stream 40 up to the surface (here a sea bottom) through a flow tube 6. At the surface 7 the oil enriched stream goes through a flexible riser 8 to a production vessel 9.

Injection water provided by an injection pump 10 at the surface 7 is forced down the well 1 in the annulus 12 between the flow tube 6 and the surrounding well wall, as indicated with the arrows 11.

The transport pump 5 is part of a downhole unit consisting of the pump 5, a water driven turbine 13 and an injection water pump 14, both pumps 5 and 14 being in drive connection with the turbine 13. The water pump 14 takes separated water 44 from the hydrocyclones 4 and deliver it to the space 15, delimited by the two packers 16 and 17 in the well 1. From this space 15 the water is re-injected through the injection line 18 which penetrates into the formation 2.

The injection water 11 from the surface pump 10 is used as a drive medium for the turbine 13 and is expelled into the space 15, wherefrom it is injected through the injection line 18.

The injection water 11 which flows down the annulus 12 is used as a cooling medium for the oil enriched stream flowing upwards through the tube 6.

In the tube 6 there is indicated an additional stream pump which is used for pressurizing the oil enriched stream.

Additional cooling may be added by means of a cooler 20 which is served by a refrigeration plant 21, for instance using Freon as refrigerating medium. It is not shown but the cooler 20 may preferably be of a type having a double jacket where the refrigerating medium flows down countercurrently to the ascending oil enriched stream and then flows back up radially outside the descending flow.

Figure 2:
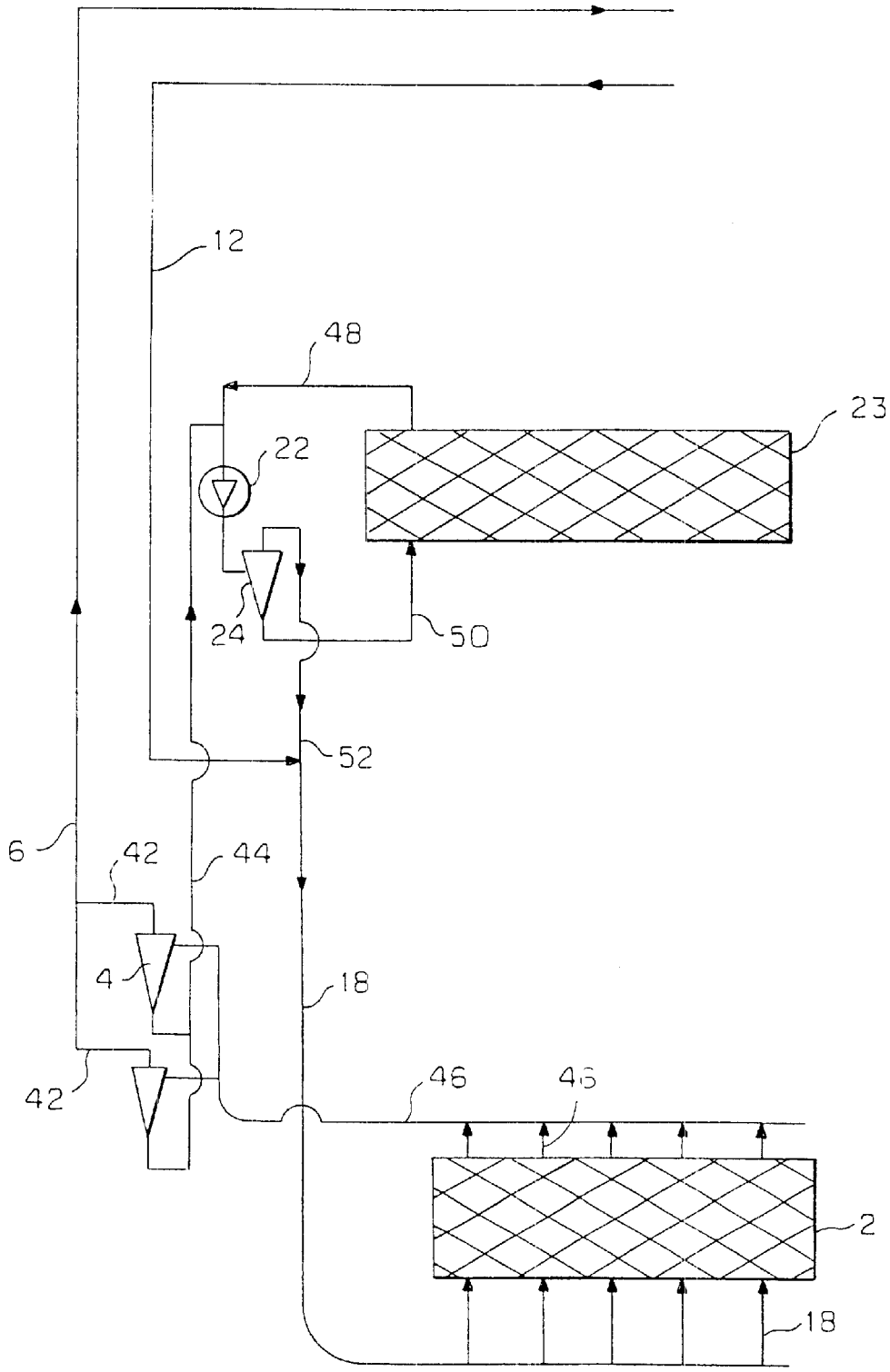
FIG. 2 is a schematic diagram of another apparatus according to the invention.

FIG. 2 depicts schematically a possible apparatus including a downhole re-injection pump 22, the inlet of which being connected to an aquifier 23 (a water containing formation) and the outlet of which being connected to the inlet of a downhole solid/liquid hydrocyclone 24. In this hydrocyclone 24 the water from the aquifier is separated in solids, which flows through a line 50 from the underflow and back to the aquifer formation 23, and re-injection water 52 which flows down for re-injection in the oil producing formation 2. As in FIG. 1 a production flow goes from the formation 2 to downhole hydrocyclones 4 where the production fluid is separated as disclosed above in connection with the apparatus in FIG. 1. The cooling of the oil enriched stream which is transported up through the line 6 (transport pump 5 omitted in FIG. 2) is not disclosed in FIG. 2.

The object of FIG. 2 is to disclose the possible inclusion of the re-injection unit 22, 24 and to show a possible adding of chemicals to the re-injection water through a supply line. Such chemicals may be viscosity reducing additives etc. Such chemicals may be added to the oil enriched stream in the tube or line 6 but the adding as shown to the re-injection waters bears the advantage that the chemicals will remain underground because they are recirculated in the system in an environmental friendly manner.

Figure 3:
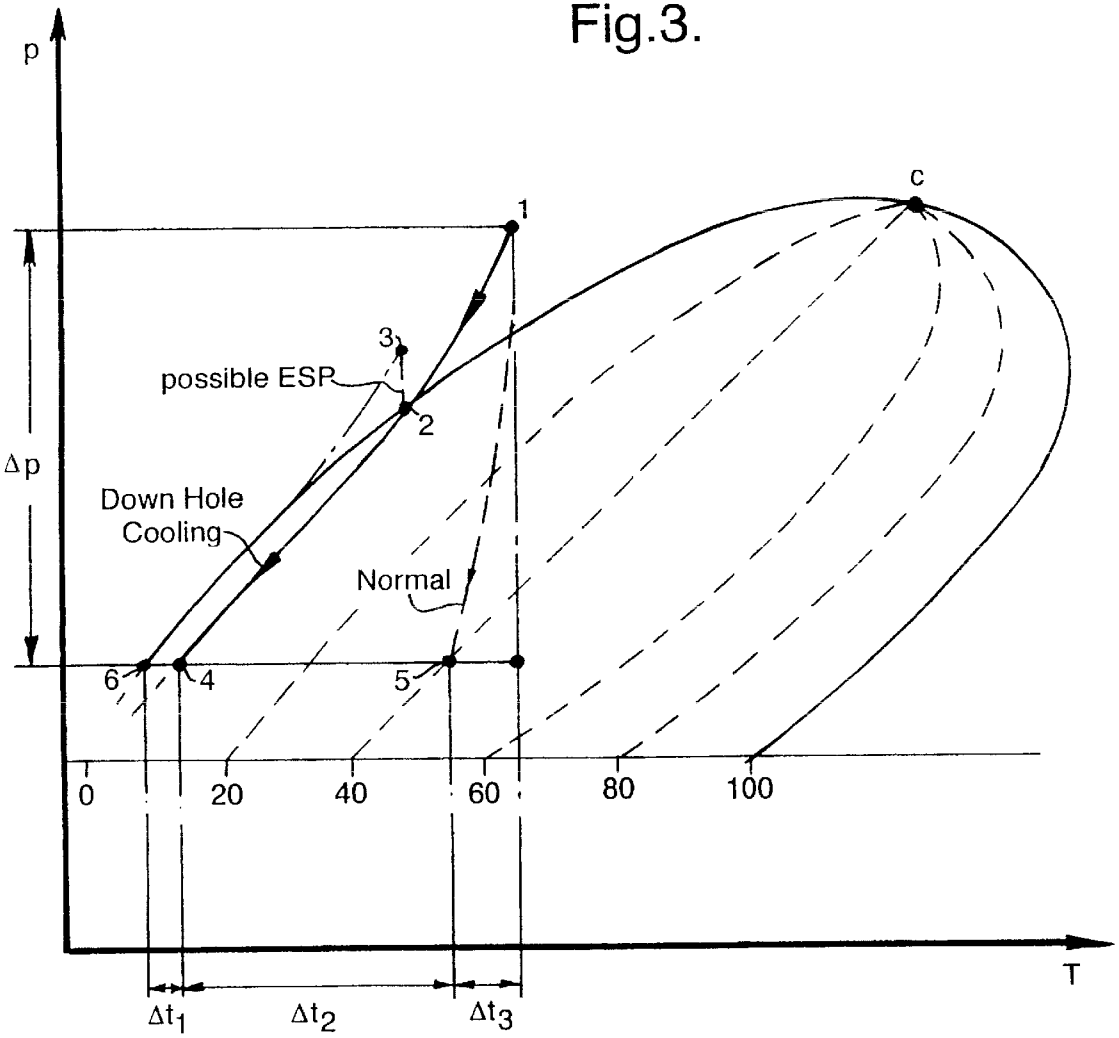
FIG. 3 is a schematic phase diagram illustrating the basic inventive idea.

The basic inventive idea is shown in FIG. 3, which is a schematical phase diagram for the oil. In the pT diagram the point 1 may be taken as a starting point. A pressure reduction would result in a moving to point 5 in the phase diagram, with corresponding formation of a gas phase, say 40% gas and 60% oil. By cooling the stream means following the line to the point 2, i.e. at or above the condensation line c, and further down to point 4. At point 2 a pressurizing in the additional pump 19 (conf. FIG. 1) will lift the position in the diagram to point 3, wherefrom a further cooling will result in point 6 on the condensation line, instead of point 4, as indicated in FIG. 3.

The effective cooling area and the mean temperature difference are favorable in the system according to the invention. The cooling area in a 3000 meter deep well will for instance be around 1000 square meters given a 4" tube, and the mean temperature difference will be up to 50 degrees C., which will represent an adequate cooling effect.

What is claimed is:

1. A method of producing an oil reservoir, comprising establishing an oil producing well, producing a production fluid containing oil and water, transporting said production fluid to a downhole liquid/liquid hydrocyclone, separating the production fluid in the liquid/liquid hydrocyclone into an oil enriched stream at the hydrocyclone overflow, and a water enriched stream at the hydrocyclione underflow, transporting the oil enriched stream to the surface, reinjecting the water enriched stream at a downhole site, cooling the transported oil enriched stream by sending a counterflow as a cooling medium relative to said oil enriched stream, thereby keeping the oil enriched stream in a substantially liquid phase, wherein said cooling medium is injection water.

2. A method as in claim 1, using said counterflow of cooling medium as a driving medium for a pump transporting said oil enriched stream.

3. A method as in claims 1 or 2, adding additional transportation energy to the oil enriched stream, thereby keeping the cooled oil enriched stream in a substantially liquid phase.

4. A method as in claim 1 or 2, said cooling medium including re-injection water provided from an aquifer.

5. An apparatus for producing an oil reservoir through an oil producing well, the apparatus comprising a downhole liquid/liquid hydrocyclone for separating a production fluid containing oil and water into an oil enriched stream and a water enriched stream, a downhole pump for pumping said oil enriched stream to the surface, and means for sending a counterflow of a cooling medium relative to the surface pumped oil enriched stream.

6. An apparatus as in claim 5, said means for sending said counterflow including a means for sending a flow of injection water down said well.

7. An apparatus for producing an oil reservoir through an oil producing well, the apparatus comprising a downhole liquid/liquid hydrocyclone for separating a production fluid containing oil and water into an oil enriched stream and a water enriched stream, a downhole pump for pumping said oil enriched stream to the surface, and means for sending a counterflow of a cooling medium relative to the surface pumped oil enriched stream, said means for sending said counterflow including a means for sending a flow of injection water down said well, including a downhole turbine driven by the injection water, said turbine being in drive connection with said downhole pump.

8. An apparatus as in claim 7, including a downhole re-injection water pump in drive connection with said downhole turbine.

9. An apparatus as in claim 8, including an additional downhole pump for transport of said cooled oil enriched stream to the surface, said additional pump being arranged in said well at a position between the said downhole pump and the surface.

10. An apparatus as in any of the claims 6–9, including a downhole solid/liquid hydrocyclone in the well at a position above said downhole pump, said downhole solid/liquid hydrocyclone having an inlet, an overflow and an underflow, said inlet being connected with an aquifer, said overflow ejecting re-injection water down the well to the reservoir, and said underflow ejecting solids enriched liquid to a downhole site, preferably to said aquifer.

11. An apparatus for producing an oil reservoir through an oil producing well, the apparatus comprising a downhole liquid/liquid hydrocyclone for separating a production fluid containing oil and water into an oil enriched stream and a water enriched stream, a downhole pump for pumping said oil enriched stream to the surface, and means for sending a counterflow of a cooling medium relative to the surface pumped oil enriched stream, including a downhole solid/liquid hydrocyclone in the well at a position above said downhole pump, said downhole solid/liquid hydrocyclone having an inlet, an overflow and an underflow, said inlet being connected with an aquifer, said overflow ejecting re-injection water down the well to the reservoir, and said underflow ejecting solids enriched liquid to a downhole site, preferably to said aquifer.

* * * * *